United States Patent [19]

Harrison

[11] 3,972,473

[45] Aug. 3, 1976

[54] SPRAY AND EVAPORATIVE AIR FRESHENER COMBINATION

[75] Inventor: Thomas S. Harrison, New Canaan, Conn.

[73] Assignee: Sterling Drug Inc., New York, N.Y.

[22] Filed: Nov. 21, 1974

[21] Appl. No.: 525,859

[52] U.S. Cl. ..... 239/34; 239/326

[51] Int. Cl.[2] ..... A24F 25/00

[58] Field of Search ..... 239/34, 43, 47, 51, 239/51.5, 55, 57, 122, 326, 499, 524, 579; 222/184, 402.13

[56] References Cited

UNITED STATES PATENTS

| | | | |
|---|---|---|---|
| 3,330,481 | 7/1967 | Dearling | 239/326 X |
| 3,361,306 | 1/1968 | Grim | 222/402.13 |
| 3,431,749 | 3/1969 | Bounds et al. | 222/402.13 X |
| 3,679,133 | 7/1972 | Sekiguchi et al. | 222/187 X |

*Primary Examiner*—John J. Love
*Attorney, Agent, or Firm*—Charles R. Fay

[57] ABSTRACT

A combined spray and evaporative air freshener or the like device which comprises a generally cylindrical ornamental shroud open at one end and having an apertured top, for application to a conventional aerosol spray container having a manually depressible valve for actuating the same. The top of the shroud has an interior bottom opening cup which in general surrounds the actuator for the valve and receives the spray upon depression of the valve stem, the spray falling in droplets into the valve cup.

An impregnated absorptive ring may be placed in the cup in position to be impinged upon by the spray in situ, the impregnated material being activated by the spray when the shroud is depressed, releasing additional fragrance into the air. The ring may also be placed in the usual valve cup surrounding the valve and in this case it is activated by the spray material dripping on it.

14 Claims, 6 Drawing Figures

SPRAY AND EVAPORATIVE AIR FRESHENER COMBINATION

BACKGROUND OF THE INVENTION

In air freshening devices it is advantageous to be able to both spray the atmosphere directly by the conventional use of an aerosol and also to provide for a slower long lasting evaporative effect. This has been accomplished by various devices in the prior art but iin the present case the object of the invention is to provide an improved evaporative action by means of a more easily actuated device, and one which is of greater decorative value.

SUMMARY OF THE INVENTION

A conventional aerosol is provided having a depressible valve actuator for a valve in a valve cup which closes the container for the material to be dispensed.

Mounted on the container and extending for most of the length thereof from the top there is provided a shroud with an open bottom so that it can be slid over the aerosol, and it has a top preferably having vent holes therein. There may also be vent holes at the side walls of the shroud adjacent the top of the remainder of the shroud preferably being solid and ornamental.

The center portion of the top of the shroud is made so that it may engage the top portion of the valve actuator of the aerosol in the position normally used by the finger to cause the device to spray through the usual orifice. Surrounding the valve actuator there is a depending skirt on the interior of the top of the shroud, this skirt forming an open bottom cup which does not engage the valve actuator but surrounds the same in the area of the orifice of the aerosol valve. Upon depression of the shroud, it depresses the valve actuator causing the same to spray through the orifice onto the inside wall of the cup, liquid thereby being formed and dropping into the valve cup where it will evaporate slowly through the vents mentioned above.

The shroud is slidable onto the aerosol, but is easily removed so that the spray may be directed into the ambient atmosphere as desired in the usual manner. When in place the shroud forms a decorative cover for the aerosol container as well as a vavle actuator as above described.

The cup may be provided with a doughnut shaped absorptive ring impregnated with a high concentration of the material to be dispersed, and this would be activated when the shroud is depressed because the spray wets the ring and releases additional material e.g., fragrance into the atmosphere. This doughnut shaped ring may be originally sealed to preserve its original fragrance during shelf life, by means of a film or the like closing the bottom of the cup, this seal being punctured when the consumer pushes the shroud down over the aerosol can. Alternatively however, the ring, or in fact a disc, impregnated with fragrance may be sold separately in foiled packets preventing fragrance loss during shelf life, the consumer merely ripping this packet open, taking out the ring, and dropping it in the valve cup. When the shroud is depressed, spray material will fall onto the ring or disc in the valve cup and the concentrate is activated as before.

The ring thus increases the concentration of the released material when using the evaporative method of dispensing.

PREFERRED EMBODIMENT OF THE INVENTION

Figure 1:
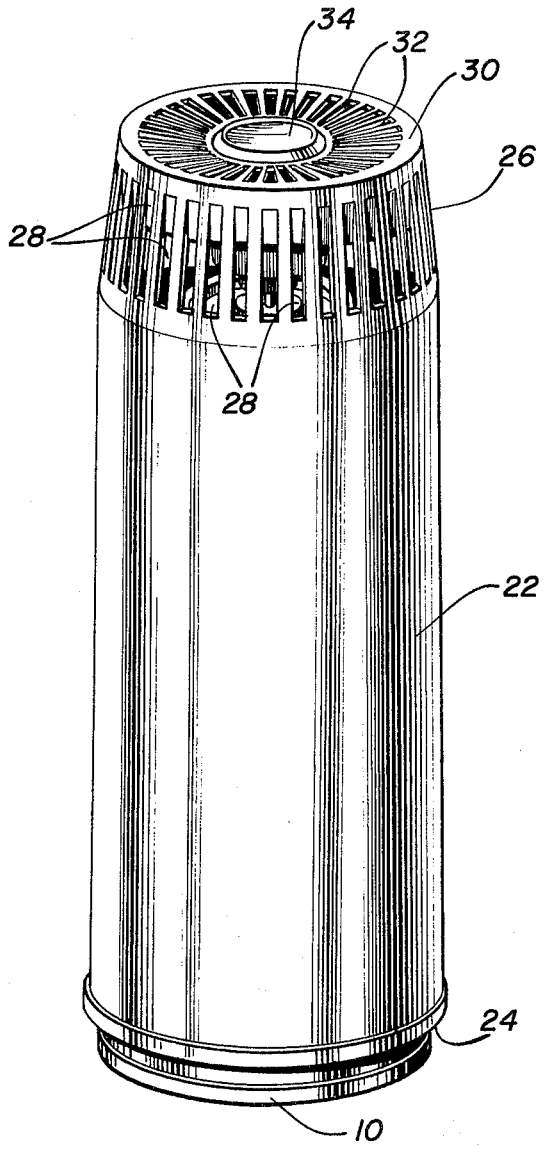
FIG. 1 is a perspective view illustrating the shroud in place on an aerosol container.
Figure 2:
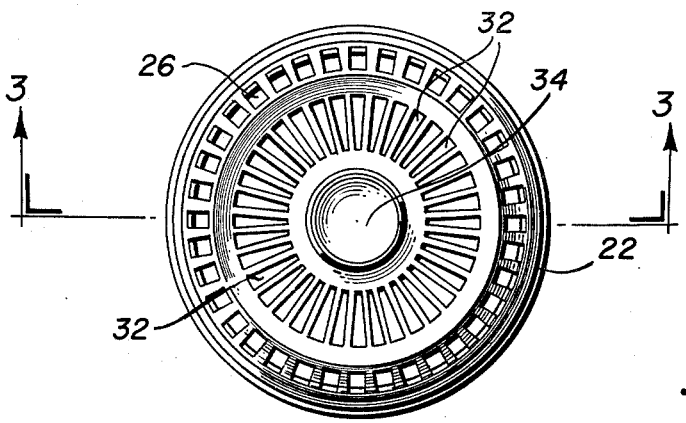
FIG. 2 is a top plan view thereof.
Figure 3:
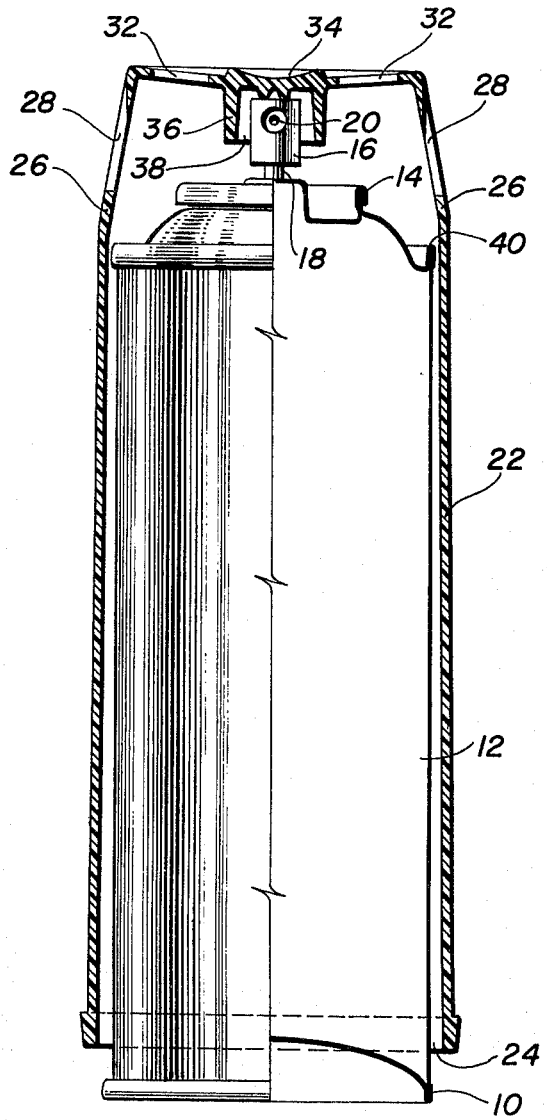
FIG. 3 is a sectional view through the shroud showing its position with respect to the aerosol container.

As shown in FIG. 1 the lower edge of a conventional aerosol container is indicated at 10. The aerosol container itself is shown in FIG. 3 being indicated at 12 and having the usual valve cup 14 and manually depressible valve actuator 16 for depressing valve stem 18, all as is well known in the art. The spray orifice is indicated at 20.

Slidably and removably mounted on this container there is a cylindrical shroud 22 having an open bottom 24 so that it can slide over the aerosol container 12 almost completely covering the same. This shroud is preferably made in one piece and has an inwardly inclined upper wall 26 slotted or otherwise apertured as shown at 28. It also has a top wall 30 likewise apertured as at 32, 32 but with a solid center portion 34.

Referring to FIG. 3, it will be seen that at the periphery of solid center portion 34 there is a depending annular skirt or wall 36 which forms a cup open at the bottom as at 38. This skirt extends downwardly far enough to obstruct the spray orifice 20.

The shroud has an interior diameter such as to be free of the crimp 40 of the aerosol can, and rests lightly on the valve stem actuator 16. The main wall of the shroud may gradually diverge downwardly as is shown in FIG. 3 so that it may be more easily applied to the aerosol.

With the shroud in place as shown in FIG. 3 it is only necessary to depress the shroud top at the portion 34 in order to actuate the valve actuator 16 to cause material to spray from the orifice 20 onto the inside surface of the cup 36. The spray forms droplets running down into the valve cup 14 where it is collected in a pool as shown at 44 in FIGS. 4 and 5. This pool of fluid material slowly evaporates through the orifice in the shroud without attention on the part of the user.

Also of course the shroud may be removed and the spray actuated directly into the atmosphere as desired, but with the shroud in position the slow evaporation effect is provided, and the shroud also forms a decorative cover for the aerosol container.

Figure 4:
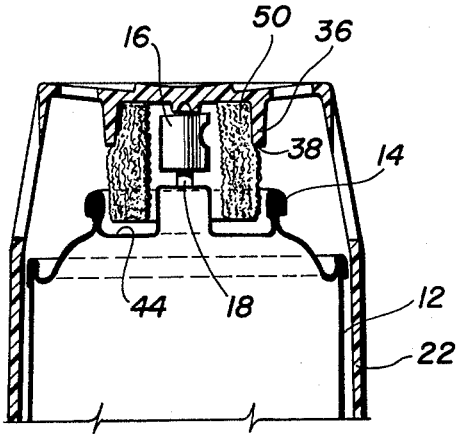
FIG. 4 is a view illustrating the ring applied to the shroud cup.
Figure 6:
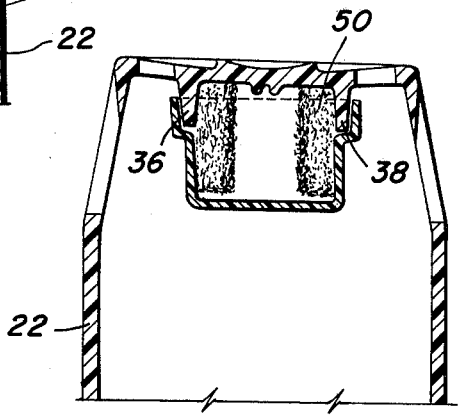
FIG. 6 illustrates a seal for the ring of FIG. 5.

Now referring to FIG. 4, the cup 36 is shown as containing an absorptive annular ring 50 or the like, the construction of the valve, shroud, etc., being the same as before. The ring is pre-impregnated with concentrated evaporative material, e.g., fragrance or the like. Upon depressing the shroud, spray will issue from the orifice onto the inner wall of the absorptive ring and activate the same, so that additional material, e.g., fragrance is released into the air. By this means, the concentration of the material in the air is increased, and any problem of too slow an evaporation or too little concentration of e.g., fragrance in the air is overcome.

Figure 5:
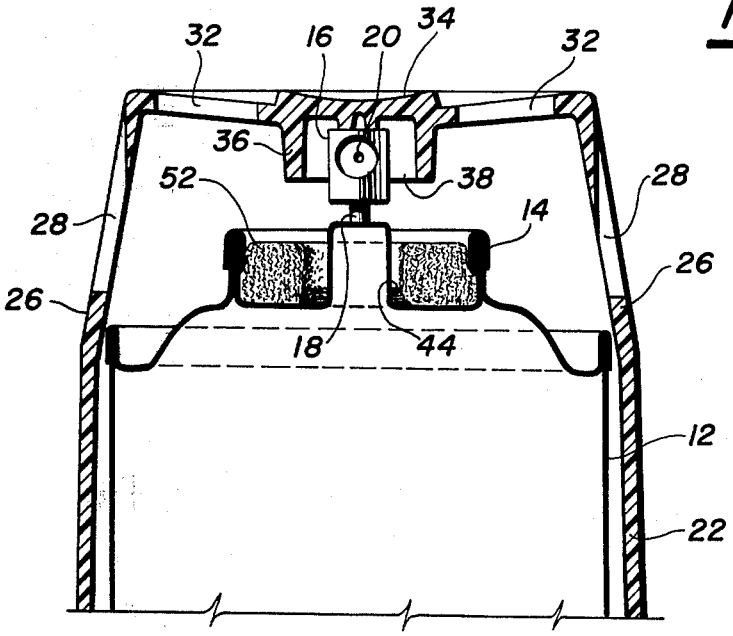
FIG. 5 illustrates a ring positioned in the valve cup.

Thus there will be a constant evaporation outwardly not only from the valve cup but also from the ring. The absorptive ring may be sealed be placing a film or the like across the open bottom of the cup and the ring. This seal would then be disrupted upon the first use by the consumer. The impregnated rings also may be sold separately in foil packets preventing fragrance loss during shelf life, and upon ripping the packet open the consumer may take out the ring 52 and drop it in the valve cup of the aerosol spray can as shown in FIG. 5. The shroud is then replaced and when the shroud is depressed the spray is collected in the valve cup by dripping down from the shroud cup and wetting the ring, activating it. In this way the effect on the evaporative action is increased.

One way of activating the concentrated material of the ring is to displace the material by the spray. That is, as the spray strikes the interior of the ring, it tends to force the concentration out through the ring. However, merely wetting the ring by means of the spray activates it to cause release of the concentrated fragrance etc.

I claim:

1. A combined spray and evaporative air freshener comprising the combination of an aerosol container having a manually depressible valve stem actuator, a valve stem, and a valve cup in which the valve stem is located, the valve actuator including a spray orifice, with a shroud for the aerosol container, said shroud comprising a hollow main body portion slidable relative to the aerosol container, said shroud having a top, a side wall, and an open bottom, a depending shroud cup with an open bottom and generally closed top at the interior of the shroud generally aligned with the valve actuator, said shroud cup including a generally solid wall in the path of the aerosol spray orifice, said shroud and its cup being bodily manually depressible causing the shroud cup top to depress the valve actuator to actuate the valve thereby spraying content of the aerosol onto the interior surface of said shroud cup, whereby fluid from the aerosol is collected thereon and descends into and is caught and held by the valve cup.

2. The combination of claim 1 wherein the portion of the shroud adjacent the top thereof is apertured.

3. The combination of claim 2 wherein the apertures are located on the side wall of the shroud.

4. The combination of claim 2 wherein the apertures are located in the top of the shroud.

5. The combinaton of claim 1 including an absorptive preimpregnated ringlike member located in the shroud cup and surrounding the valve actuator in positon to receive spary therefrom.

6. A combined spray and evaporative air freshener comprising an aerosol container including a valve cup, a valve stem therein, a manually depressible valve stem actuator on the valve stem, and a spray orifice in the actuator, a shroud for the aerosol container, said shroud being slidably mounted in the aerosol container and comprising an elongated hollow main body portion open at one end having a generally closed top at the other end so that the shroud may be slid over the aerosol container, the shroud extending for at least the major portion of the height of the aerosol container, means at the interior of the top of the shroud for contact with the valve actuator to depress the same and the valve stem upon bodily motion of the shroud and said means with respect to the aerosol container, and means on the shroud intercepting the resultant spray from the orifice causing the spray to drop into the valve cup.

7. The combined spray and evaporative air freshener of claim 6 wherein the means intercepting the spray depends from the interior of the top of the shroud terminating at a point below the orifice and moves with the shroud.

8. The combination of claim 7 wherein said spray intercepting means comprises a generally continuous depending wall forming an inverted cup receiving the valve actuator when the shroud is in position on the aerosol.

9. The combination of claim 6 including a pre-impregnated absorptive member located on said spray intercepting means in position to receive the spray on the shroud.

10. The combination of claim 9 wherein said absorptive member is in the form of a ring and said spray intercepting means is in the form of an inverted bottom opening cup.

11. A combined spray and evaporative air freshener comprising the combination of an aerosol container having a manually depressible valve stem actuator, a valve stem, and a valve cup in which the valve stem is located, the valve actuator including a spray orifice, with a shroud for the aerosol container, said shroud comprising a hollow main body portion slidable relative to the aerosol container, said shroud having a top, a side wall, and an open bottom, a depending shroud cup with an open bottom and generally closed top at the interior of the shroud generally aligned with the valve actuator, said shroud cup including a wall in the path of the aerosol spray orifice, said shroud and its cup being bodily manually depressible causing the shroud cup top to depress the valve actuator to actuate the valve thereby spraying content of the aerosol onto the interior surface of said shroud cup, whereby fluid from the aerosol is collected thereon and descends into and is caught and held by the valve cup, and an absorptive pre-impregnated ring located in the aerosol valve cup surrounding the valve stem, and receiving a spray dripping from the depending shroud cup.

12. A combined spray and evaporative air freshener comprising the combination of an aerosol container having a manually depressible valve stem actuator, a valve stem, and a valve cup in which the valve stem is located, the valve actuator including a spray orifice, with a shroud for the aerosol container, said shroud comprising a hollow main body portion slidable relative to the aerosol container, said shroud havng a top, a side wall, and an open bottom, a depending shroud cup with an open bottom and generally closed top at the interior of the shroud generally aligned with the valve actuator, said shroud cup including a wall in the path of the aerosol spray orifice, said shroud and its cup being bodily manually depressible causing the shroud cup top to depress the valve actuator to actuate the valve thereby spraying content of the aerosol onto the interior surface of said shroud cup, whereby fluid from the aerosol is collected thereon and descends into and is caught and held by the valve cup, an absorptive pre-impregnated ringlike member located in the shroud cup and surrounding the valve actuator in position to receive spray therefrom, and a seal across the open end of the shroud cup, the center portion of the shroud top being closed in the area of the shroud cup so that until use the absorptive ring is impervious to the atmosphere, preserving the impregnated material.

13. A combined spray and evaporative air freshener comprising an aerosol container including a valve cup, a valve stem therein, a manually depressible valve stem actuator on the valve stem, and a spray orifice in the actuator, a shroud for the aerosol container, said shroud being slidably mounted in the aerosol container and comprising an elongated hollow main body portion open at one end and having a generally closed top at the other end so that the shroud may be slid over the aerosol container, the shroud extending for at least the major portion of the height of the aerosol container, means at the interior of the top of the shroud for contact with the valve actuator to depress the same and the valve stem upon bodily motion of the shroud and said means with respect to the aerosol container, and means on the shroud intercepting the resultant spray from the orifice causing the spray to drop into the valve cup, and a pre-impregnated absorptive device located in the aerosol valve cup.

14. The combination of claim 13 wherein the absorptive device is in the form of a ring surrounding the valve stem in general conformance with the valve cup and receives spray in the form of drop from the means intercepting the spray.

* * * * *

UNITED STATES PATENT OFFICE

CERTIFICATE OF CORRECTION

Patent No. 3,972,473 Dated August 3, 1976

Inventor(s) Thomas S. Harrison

It is certified that error appears in the above-identified patent and that said Letters Patent are hereby corrected as shown below:

Column 1, line 10, "iin" should read -- in --.

Column 2, line 48, "orifice" should read -- orifices --.

Column 3, line 1, "be" , second occurrence, should read - by -

Column 3, line 60, insert - and - after "one".

Column 4, lines 16-17 delete [on the shroud].

Column 4, line 21, insert - on the shroud - after "cup".

Column 4, line 55, "havng" should read -- having --.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*